US005466041A

United States Patent [19]

Hoffman et al.

[11] Patent Number: 5,466,041

[45] Date of Patent: Nov. 14, 1995

[54] OTTOMAN INCLUDING STORAGE RECEPTACLE

[75] Inventors: D. Stephen Hoffman; Charles F. Lowe, both of High Point, N.C.

[73] Assignee: Ultra-Mek, Inc., Denton, N.C.

[21] Appl. No.: 371,928

[22] Filed: Jan. 12, 1995

Related U.S. Application Data

[63] Continuation of Ser. No. 84,511, Jun. 29, 1993.

[51] Int. Cl.[6] ..... A47C 7/62

[52] U.S. Cl. ..... 297/188.1; 297/334

[58] Field of Search ..... 297/188.01, 188.08, 297/188.09, 188.1, 188.13, 188.21, 423.41, 423.39, 334, 335, 109, DIG. 10; 312/235.5, 293.2; 5/5, 96, 308, 503

[56] References Cited

U.S. PATENT DOCUMENTS

| | | | |
|---|---|---|---|
| D. 151,983 | 12/1948 | Guertin . | |
| D. 151,984 | 12/1948 | Guertin . | |
| D. 160,390 | 10/1950 | Hubbert | D15/8 |
| 213,512 | 3/1879 | Landis . | |
| 577,138 | 2/1897 | Hubbard . | |
| 640,647 | 1/1900 | Gannett . | |
| 1,018,593 | 2/1912 | Swanson . | |
| 1,509,863 | 9/1924 | Erickson | 297/334 X |
| 2,577,741 | 12/1951 | Creveling et al. | 297/109 |
| 2,579,577 | 12/1951 | Hill . | |
| 2,582,703 | 1/1952 | Kirshbaum . | |
| 2,625,204 | 1/1953 | Reichman . | |
| 2,635,678 | 4/1953 | Basil . | |
| 2,696,870 | 12/1954 | Mende | 297/193 X |
| 2,804,122 | 8/1957 | Baum | 297/193 X |
| 2,812,227 | 11/1957 | Hill | 312/290 |
| 2,838,097 | 6/1958 | Gleitsman et al. | 155/169 |
| 2,877,830 | 3/1959 | Smith | 155/169 |
| 2,950,753 | 8/1960 | Glutsman et al. | 297/193 |
| 3,114,574 | 12/1963 | Pryale | 297/193 |
| 3,145,049 | 8/1964 | Duke . | |
| 3,227,112 | 1/1966 | Wiseman . | |
| 3,451,718 | 6/1969 | Kaufman | 297/334 X |
| 4,083,599 | 4/1978 | Gaffney | 297/DIG. 10 X |
| 4,834,449 | 5/1989 | Engelman . | |
| 5,160,183 | 11/1992 | Rusyniak . | |

FOREIGN PATENT DOCUMENTS

| | | | |
|---|---|---|---|
| 814708 | 7/1949 | Germany | 297/193 |
| 195920 | 2/1938 | Switzerland | 297/193 |
| 2601 | 2/1900 | United Kingdom . | |
| 240085 | 9/1925 | United Kingdom . | |

*Primary Examiner*—Laurie K. Cranmer
*Attorney, Agent, or Firm*—Bell, Seltzer, Park & Gibson

[57] ABSTRACT

An ottoman having a removable cover for storage within is disclosed. The cover is movable between a closed position, in which it resides above the walls of the ottoman, and an open position, in which the cover is generally vertically disposed, confronts the rear wall of the ottoman, and is adjacent the underlying floor. This configuration provides an ottoman that is much less susceptible to tipping in the open position.

11 Claims, 2 Drawing Sheets

OTTOMAN INCLUDING STORAGE RECEPTACLE

This is a continuation of copending application Ser. No. 08/084,511, filed on 29 Jun. 1993.

FIELD OF THE INVENTION

This invention relates generally to footstool-type ottomans, and relates more specifically to ottomans having a storage receptacle within.

BACKGROUND OF THE INVENTION

Quite often a seating unit within a home will be accompanied by a footstool, such as an ottoman or hassock. Footstools are, of course, generally placed in front of the seating unit and thereby provide a surface upon which occupants of the seating unit can rest their feet.

Footstools can additionally serve as storage receptacles for articles such as books, magazines, cards and games, writing instruments, sewing materials, beverages, and the like. See e.g., U.S. Pat. No. 2,812,227 to Hill; U.S. Pat. No. D160,390 to Hubbert. The typical storing ottoman has a removable top that, upon removal, exposes a storage receptacle within the vertical walls of the ottoman. The cover may be completely detachable or may be pivotally interconnected to the top of one of the vertical walls. See Hubbert, supra. Of these, the pivotally interconnected cover is generally preferred for the convenience it affords. The pivotal interconnection of the cover to the base precludes the need to the operator to locate an appropriate spot to store the cover when it is removed or to search for the cover when it is to be replaced.

Despite its clear advantages, an ottoman with a pivotally attached cover does have shortcomings inherent in its basic configuration, each of which is safety-related. When the cover of such ottoman is opened, it pivots from a generally horizontal disposition atop the base walls through an upright disposition directly above the base wall about which it pivots, then continues to a fully open position in which it is disposed at an angle between the upright position directly above the base wall and an inverted horizontal disposition adjacent and external to the base. The disposition of the cover is governed by the presence of a motion halting structure, such as a chain, that may be attached to the ottoman, or by the configuration of the cover cushion itself. For comfort, most ottomans have a relatively thick cover cushion that bulges somewhat from the peripheral edges of the cover. As the cover reaches the fully opened position, the bulging portion of the cushion contacts the base wall and thus prevents the cover from reaching or even approaching the inverted horizontal position. The typical cover opens fully to an angle of approximately 30 degrees relative to horizontal. In this configuration, the cover of the ottoman is typically between 6 and 10 inches from the underlying floor. As a result, the ottoman can be quite unstable and thus is prone to tipping; this can be particularly problematic if the ottoman is in a location where children or pets may be tempted to pull on or hang from the open cover.

The second related problem concerns the ease of returning the cover to the closed position. Once the cover is moved from the fully open position past the upright position above the base wall, the center of gravity of the cover is positioned over some portion of the footprint of the base. As the pivot is located on a base wall, positioning the center of gravity within the base footprint causes the weight of the cover to assist the closing of the cover. This leads to a tendency for the cover to slam shut into the closed position, which again can be problematic in the presence of children or pets. Also, operators who are weak or infirm may also risk injury due to slamming. This problem is exacerbated by the inability of the cover to reach a fully inverted horizontal position, as it takes relatively little force to raise the cover from the open position past the upright position to an orientation in which the cover is prone to slamming.

In view of the foregoing, it is a first object of the present invention to provide an ottoman with improved stability when the top cover is in the open position.

It is a second object of the present invention to provide an ottoman with a reduced tendency to slam forcefully into the closed position.

It is a third object of the present invention to provide a mechanism suitable for use in such an ottoman.

SUMMARY OF THE INVENTION

These and other objects are satisfied by the present invention, which as a first aspect includes an ottoman comprising: a base configured to rest on an underlying surface and including upright wall means; a removable cover having a lower portion and a rear edge portion; and means attached to the base and to the cover for moving the removable cover between a closed position, wherein the removable cover is generally horizontally disposed above the upright wall means of the base, and an open position, wherein the cover is disposed generally vertically, the lower portion of the cover confronts the upright wall means, and the rear edge portion of the cover is adjacent the underlying surface. Preferably the means for moving the cover between the closed and open positions is a four-bar linkage pivotally interconnected with the cover and the base.

A second aspect of the present invention is a four-bar linkage mechanism suitable for use with such an ottoman.

DETAILED DESCRIPTION OF THE INVENTION

The present invention will now be described herein in greater detail. The illustrated embodiment is not intended to be limiting; rather, this embodiment is included to provide those skilled in this art with a full and complete understanding of the invention.

The present invention relates to an ottoman having a storage receptacle within. The ottoman will generally be placed adjacent the seat portion of a seating unit, such as a couch, love seat, chair, pit-style sofa, and the like. The ottoman can, in the closed position, serve as a footrest. With the cover in its open position, the ottoman provides a convenient storage receptacle.

As used herein, "forward", "forwardly" and "front" all refer to the direction parallel with the floor extending from the ottoman toward the adjacent seating unit Conversely, the terms "rear", "rearward", and "rearwardly" all refer to the direction parallel with the floor extending from the ottoman away from the seating unit. The term "lateral" refers to the direction parallel with the floor, perpendicular to the forward and rearward directions, and extending away from the center of the ottoman. The terms "medial," "inward", and "inboard" all refer to the direction that is the converse of the lateral direction, i.e., the direction parallel with the floor, perpendicular to the forward direction, and extending from the ottoman periphery toward its center.

Figure 1:
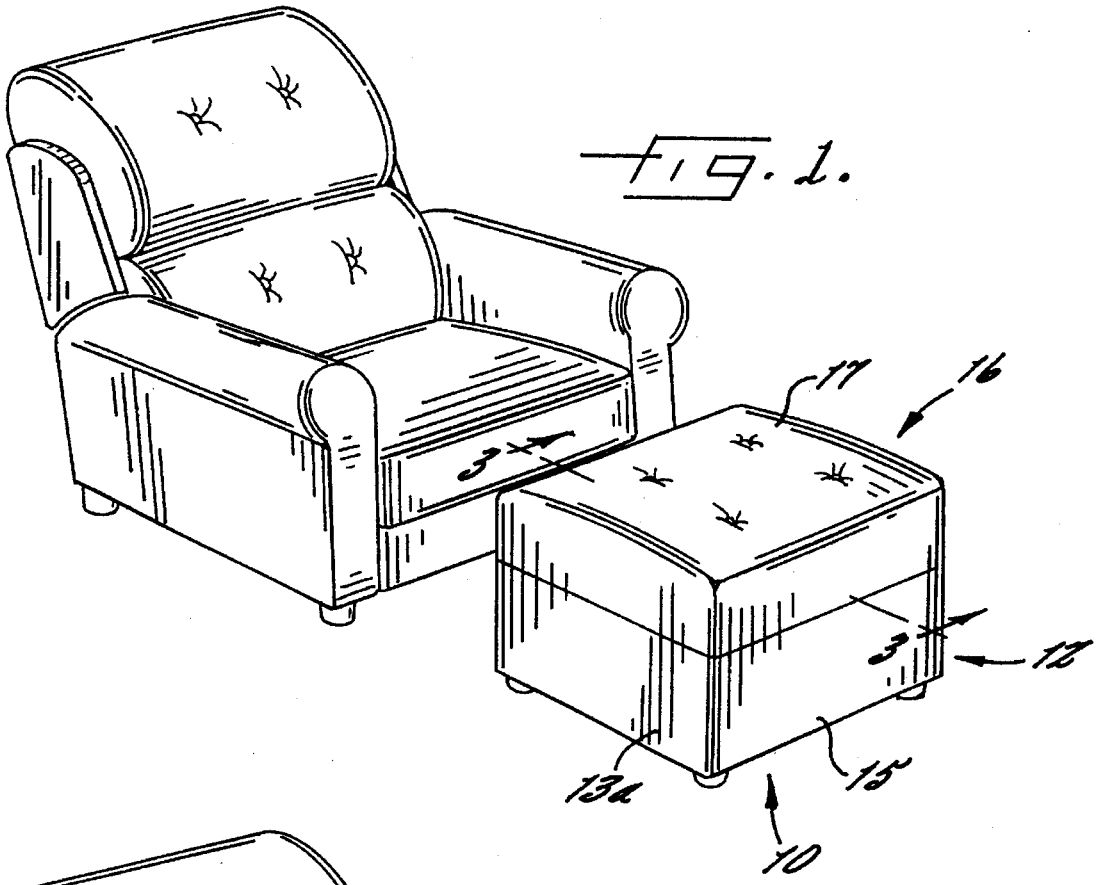
FIG. 1 is a perspective view of an ottoman having a storage receptacle with its cover in the closed position.

Referring now to the drawings, an ottoman illustrated broadly at 10 is shown in FIG. 1. The ottoman 10 comprises a base 12, a top cover 16, a pair of cover mechanisms 30, 30*a*, and a storage receptacle 70. The base 12 rests upon the floor through a quartet of casters 21, although it can also be configured to rest upon the underlying surface S through a plurality of legs, a lower floor-mating surface, and the like. The base 12 includes a floor 23, lateral walls 13, 13*a*, a front wall 14, and a rear wall 15, which together form the periphery of the ottoman 10 and define a cavity 11 therein. The cover 16 comprises a top decorative cushion 17 which is attached to a lower plate 18. Each of a pair of rails 19, 19*a* (19*a* not shown) extends between the lateral front and rear portions of the underside of the plate 18. Although the ottoman illustrated herein has a rectangular footprint defined by walls 13, 13*a*, 14, and 15, those skilled in this art will understand that the shape of the ottoman footprint is not critical to the invention; any wall means that provides a defining external shape to the ottoman, such as square, circular, ovoid, and the like, is suitable for use with this invention.

The cover 16 is movable between a closed position, wherein the cover 16 is generally horizontally disposed above the walls 13, 13*a*, 14, 15, (FIG. 3), and an open position, wherein the cover 16 resides rearwardly of the base 12 (FIG. 5), the lower portion of the cover 16 (represented in this embodiment by the lower surface portions 22, 22*a* (22*a* not shown) of the rails 19, 19*a*) confronts the rear wall 15, and the rear edge portion 20 of the cover 16 is adjacent the surface S underlying the ottoman 10. As used herein, a generally vertical disposition of the cover 16 means that the cover 16 is disposed so that the angle formed between the top surface of the cover and the underlying surface S is between about 60 and 120 degrees, and preferably is between 75 and 105 degrees.

Figure 2:
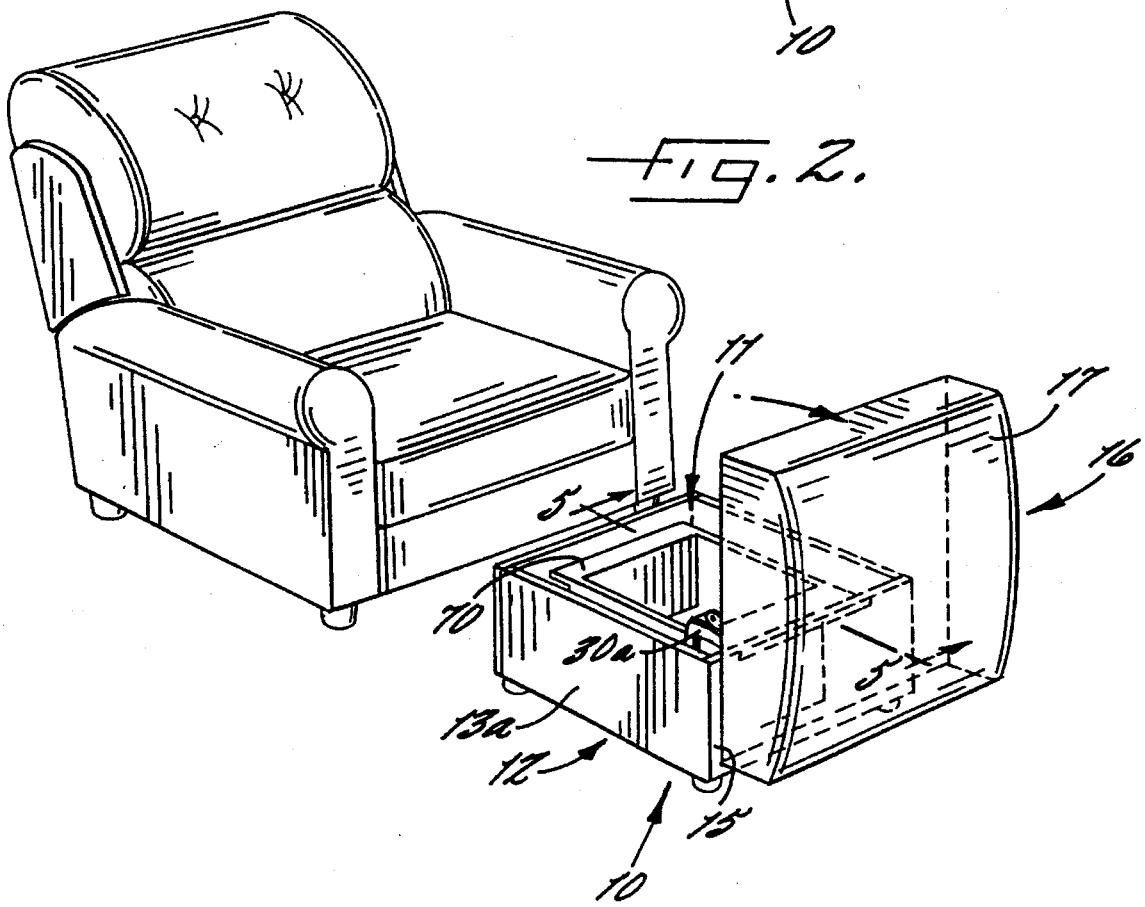
FIG. 2 is a perspective view of an ottoman having a storage receptacle with the top cover in its open position.

The movement of the top cover 16 relative to the base 12 is controlled by the pair of cover mechanisms 30, 30*a*. Each of the cover mechanisms 30*a* comprises a mounting bracket 31, a front pivot link 40, a rear pivot link 50, and a cover mounting bracket 60. The cover mechanisms 30, 30*a* are mirror images of one another about a plane of symmetry P (FIG. 2) parallel to and equidistant between the lateral walls 13, 13*a* of the base 12. In the interest of clarity and brevity, only the cover mechanism 30 will be described in detail herein; those skilled in this art will appreciate that this discussion is equally applicable to the mirror image cover mechanism 30*a*. Those skilled in this art will appreciate that, although the illustrated mechanism configuration is preferred, there are any number of alternative mechanism configurations, including both four-bar linkages and other types, that can control the movement of the cover 16 from the closed position to the open position illustrated herein. As used herein, a "four-bar linkage" is intended to mean a hinged chain of links having one rotational degree of freedom and equivalent structures, such as slider-crank mechanisms, see, e.g., Paul, *Kinematics and Dynamics of Planar Machinery* (Prentice-Hall, Inc. 1979), and is intended to encompass mechanical configurations having multiple interconnected four-bar linkages.

The mounting bracket 31 (FIGS. 3 and 4) comprises a generally horizontal lower arm 35, a central arm 36 fixed substantially perpendicularly to the rearmost portion of the lower arm 35 and extending upwardly therefrom, and an upper arm 37 fixed substantially perpendicularly to the uppermost end of the central arm 36 and extending rearwardly therefrom. The mounting bracket 31 includes at opposite ends apertures 38 which receive threaded fasteners 39 for fixed attachment to the rearward portion of the lateral wall 13 of the base 12. A vertex 47 positioned at the junction of the lower arm 35 and the central arm 36 includes the pivot 33 for pivotal interconnection with the front pivot link 40; also a pivot 34 is positioned on the central arm 36 upwardly from the pivot 33 for pivotal interconnection with the rear pivot link 50. Although the mounting bracket 31 is illustrated herein, those skilled in the art will appreciate that any means that provides the pivots 33, 34 for pivotal movement of the front and rear pivot links 40, 50 relative to the lateral wall 13 is suitable for use with the present invention. Exemplary alternatives include a mounting plate, sleeve bushings recessed in or projecting from the lateral wall 13, or even apertures in the lateral wall 13 itself adapted to receive a threaded fastener, a pivot pin, and the like. The upper arm 37 includes in its central portion a stop pin 46 that projects inwardly to interfere with and cease the motion of the rear pivot link 50 as it reaches the open position.

The rear pivot link 50 is pivotally attached to the mounting bracket 3 at the pivot 34 located on the central portion of the central arm 36 of the mounting bracket 3. Those skilled in this art will understand that this pivot, as well as the other pivots illustrated herein, can comprise any means which permits pivotal movement of one link upon another, including rivets, nuts and bolts, pivot pins, and the like. The rear pivot link 50 has a lower arm 52 and an upper arm 53 which are fixed to one another substantially perpendicularly. The upper arm 53 is pivotally connected with the cover mounting bracket 60 at a pivot 41 located at end of the upper arm 53 opposite its attachment thereof with the lower arm 52.

The front pivot link 40 is pivotally interconnected with the mounting bracket 31 at the pivot 33 located on the lower arm 35 of the mounting bracket 31. The front pivot link comprises a lower arm 42, a central arm 43, and an upper arm 44. The lower arm 42 is fixed to the central arm 43 so that the angle formed therebetween is approximately 160°. The upper arm 44 is fixed to the central arm 43 at approximately a 150° angle. At the end of the lower arm 42 opposite the central arm 43, a stabilizer tube 46 of square cross-section is fixed; this stabilizer 46 extends to a fixed attachment at the same location on the lower arm of the front pivot link of mechanism 30*a* on the opposite side of the pivotal ottoman 10. The stabilizer tube 46 acts to unify the movement of the mechanisms 30, 30*a*, and to provide lateral stability.

The cover mounting bracket 60 comprises a lower arm 61 and upper arm 62 fixed to the lower arm 61 so that the angle formed therebetween is approximately 135°. The upper arm 62 includes three mounting apertures 63 that receive threaded fasteners 64 for attachment of the mounting bracket 60 to the side rails 19, 19*a* of the cover 16. The mounting bracket 60 is attached to the rails 19, 19*a* so that the upper arm 62 is disposed generally horizontally in the closed position and the lower arm 61 extends downwardly and forwardly from the vertex 65. The lowermost end of the lower arm 61 includes the pivot 51 through which the cover mounting bracket 60 is pivotally interconnected with the front pivot link 40. Approximately halfway between the pivot 51 and the vertex 65 of the lower arm 61 and the upper arm 62 is the pivot 41 through which the cover mounting bracket 60 is pivotally interconnected with the rear pivot link 50. Those skilled in this art will appreciate that, although the cover mounting bracket 60 illustrated herein is preferred, any means that provides attachments for pivotal movement between the cover 16 and the front and rear pivot links 40, 50, such as sleeve bushings or direct attachment to apertures in the side rails 19, 19*a*, is suitable for use with this invention.

The storage receptacle 70 resides within the cavity 21. The storage receptacle 70 rests upon a block shelf 71 which is fixed directly to the rear wall 15, and also rests upon a block shelf 72 that is fixed to the front wall 14. The receptacle 70 can be a single unit or can be subdivided into any number of compartments as desired.

Figure 3:
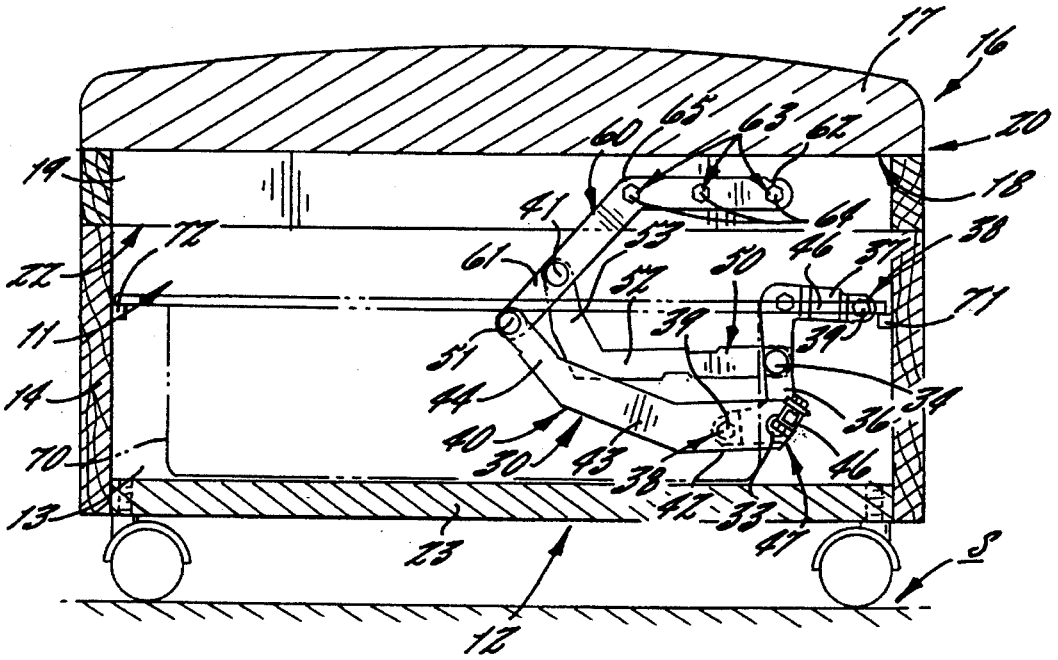
FIG. 3 is a side view of the ottoman with the top cover in its closed position.
Figure 4:
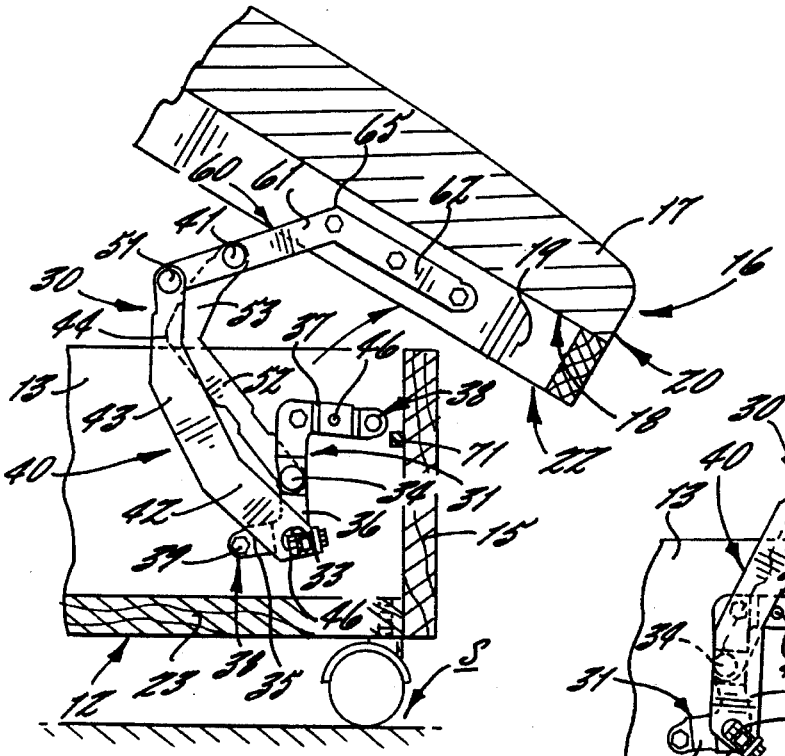
FIG. 4 is a side view of the ottoman with the top cover at the balance point in its travel path between the closed and open positions.
Figure 5:
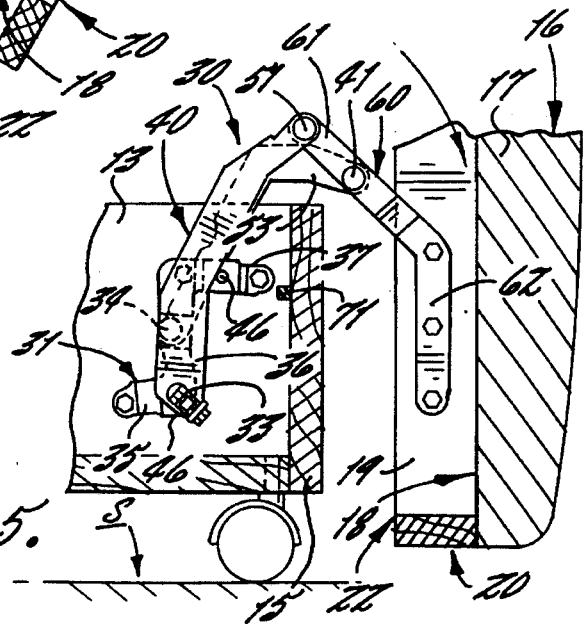
FIG. 5 is a side view of the ottoman with the top cover in its open position.

To move the ottoman 10 from the closed position of FIG. 3 to the open position of FIG. 5, an operator provides an upward force on the forward edge of the cover 16. This force draws the cover and the cover mounting bracket 60 fixed thereto upwardly and rearwardly. The upward and rearward movement of the pivots 41 and 51 causes rotation of the rear pivot link 50 and front pivot link 30 about pivots 41 and 51, respectively, so that the upper arms 53 and 44 move upwardly and rearwardly. This action continues, with the cover 16 gradually rotating from a generally horizontal disposition to a generally vertical disposition, until the center arm 43 of the front pivot link 40 strikes the stop pin 32 as the cover 16 reaches the open position (FIG. 5), wherein the rear edge 20 of the cover 16 is adjacent to the floor. In this position the cover 16 is sufficiently removed from the base 12 that the storage receptacle 70 can be accessed by the operator.

It can be seen that in the open position, the rear edge portion 20 of the cover 16 is adjacent the underlying surface S and the lower rail surfaces 22, 22*a* of the rails 19, 19*a* confront the rear wall 15. In this configuration, the ottoman is quite resistant to toppling over due to a rearward or downward force applied to the cover 16 (the type of force applied by a child or pet climbing on or suspended from the cover 16). If such a force is applied to the cover 16, the ottoman 10 tips only slightly before the rear edge portion 20 of the cover 16 contacts the underlying surface S. From this tipped position, an extremely strong force must be applied to cause the ottoman 10 to tip further. In contrast, an ottoman having a cover hinged to the top portion of the rear wall that moves into a horizontally-disposed open position is quite susceptible to tipping due to a rear wall or downward force on the cover, and is further susceptible to subsequently slamming shut in an inverted position. Preferably, in the open position the rear edge portion 20 resides within 3 inches of the underlying surface; also, preferably the lower rail surfaces 22, 22*a* of the rails 19, 19*a* are disposed within 1 to 4 inches of the rear wall 15.

Further, because of the orientation of the cover 16 relative to the base 12 in the open position, and the path the cover 16 follows from the open to the closed position, the ottoman 10 of the present invention is less prone to slamming when moving from the open position to the closed position. As described above, the cover of an ottoman hinged to the top of an ottoman wall encourages, by its weight alone, movement to the closed position as the cover passes through an upright vertical orientation while moving to the closed position. Movement to the closed position is encouraged due to the center of gravity of the cover moving to a position over a portion of the ottoman footprint forward of the pivot. Relatively little force is required to move the cover from the fully open position inverted to the upright position; small children and pets are certainly capable of providing such force. Also, the force with which the cover slams is significant, as the front edge of the cover accelerates from a point located above the base at a height equal to that of the front-to-rear length of the cover.

In contrast, the cover 16 of the present invention initially travels essentially upwardly with substantially no forward or rearward movement prior to its moving any significant distance forwardly in order for the cover 16 to avoid contacting the rear wall 15 during operation. Generally the distance is between about 4 to 8 inches. The cover 16 then moves both upwardly and forwardly to the balanced position shown in FIG. 4. The shape of this path alone reduces the tendency of the ottoman cover to slam, as considerable force is required to elevate the cover 16 to this position. Further, the balance point (i.e., an intermediate position in the travel path of the cover 16 as it moves from the open to the closed position beyond which it will encourage closing due to the weight of the cover) occurs in the illustrated embodiment as the cover 16 is disposed at an angle of between about 20 and 45 degrees relative to horizontal. In this position, the distance from the front edge of the cover 16 to the top of the base 12 is considerably less than that for a simple ottoman, and thus the slamming force due to free-falling acceleration is significantly decreased.

It is noteworthy that, because of the tripartite configuration of the front pivot link 40 and the angled configurations of the rear pivot link 50 and the cover mounting bracket 60, very little of the material comprising these links is visually exposed above the base 12. This improves the appearance of the ottoman with the cover 16 in the open position. Also, there are no "pinch-points" created during the opening of the cover 16 between these links and the rear wall 15; instead, the tripartite configuration of the front pivot link 40 and the angled configuration of the cover mounting bracket 60 and the rear pivot link 50 cause these links to be spaced away from the internal and external surfaces and the top edge of the rear wall 15. Preferably, the distance between these links and the wall is at least 1.5 inches. Those skilled in this art will appreciate that smoothly curved links that approximate the tripartite profile of the front pivot link 40 and the angled profiles of the rear pivot link 50 and the cover mounting bracket 60 could also be employed with this invention and provide the same benefits as the links illustrated herein.

The foregoing embodiments are illustrative of the present invention, and are not to be construed as limiting thereof. The invention is defined by the following claims, with equivalents of the claims to be included therein.

That which is claimed is:

1. An ottoman comprising:

(a) a base configured to rest on an underlying surface and including upright wall means;

(b) a removable cover having a lower portion and a rear edge portion; and (c) four-bar linkage means pivotally interconnected with said base and said cover for moving said removable cover between a closed position, wherein said removable cover is generally horizontally disposed above said upright wall means of said base, and an open position, wherein said cover is disposed generally vertically, said lower portion of said cover confronts said wall means, and said rear edge portion of said cover is adjacent the underlying surface.

2. An ottoman according to claim 1, wherein said four-bar linkage means comprises a pair of four-bar linkages.

3. An ottoman according to claim 2, wherein each of said four-bar linkages comprises:

(a) base mounting means fixed to said base;

(b) a front pivot link pivotally interconnected at a first pivot to said base mounting means;

(c) a rear pivot link pivotally interconnected at a second pivot to said base mounting means, said second pivot being positioned above said first pivot on said base mounting means; and (d) cover mounting means fixed to said cover, pivotally interconnected to said front pivot link at a third pivot, and further pivotally interconnected to said rear pivot link at a fourth pivot, said fourth pivot being positioned upwardly and rearwardly of said third pivot when said cover is in the closed position.

4. An ottoman according to claim 3, wherein in the closed position, said third pivot and said fourth pivot are positioned below said lower portion of said cover.

5. An ottoman according to claim 1, wherein said four-bar linkage means is configured so that as said cover moves from the open position toward the closed position, said rear edge portion of said cover moves substantially vertically from the open position for between about 4 and 8 inches.

6. An ottoman according to claim 1, wherein said base further includes a lower surface, said lower surface and said wall means defining an internal cavity; and wherein said ottoman further comprises storage means residing within said internal cavity.

7. An ottoman according to claim 1, wherein in the open position, said rear edge portion of said cover resides within 3 inches of said underlying surface.

8. An ottoman according to claim 1, wherein in the open position said lower portion of said cover resides between about 1 and 4 inches from said upright wall means.

9. An ottoman according to claim 1, wherein said base further comprises caster means for unconstrained horizontal movement of said ottoman relative to the underlying surface.

10. An ottoman according to claim 1, wherein said cover is movable to an intermediate balanced position between the closed position and the open position, and wherein in the balanced position, said cover is disposed at an angle of between about 20 and 45 degrees relative to horizontal.

11. A mechanism suitable for use with an ottoman having a base configured to rest on an underlying surface and a removable cover, the base including upright wall means, the cover including a rear edge portion and a lower surface, the removable cover being movable between a closed position, in which the cover is disposed generally horizontally above the base, and a closed position, in which the cover is generally vertically disposed rearwardly of said base, the rear edge portion of the cover is adjacent the underlying surface, and the lower surface of the cover confronts the base, said mechanism comprising:

(a) a base mounting bracket adapted to be fixed to said base;

(b) a front pivot link pivotally interconnected at a first pivot to said base mounting bracket;

(c) a rear pivot link having a lower arm pivotally interconnected at a second pivot to said base mounting bracket, and an upper arm fixed substantially perpendicularly to said lower arm, said second pivot being positioned above said first pivot on said base mounting bracket when said base mounting bracket is fixed to the base; and (d) a cover mounting bracket adapted to be fixed to said cover and including a lower arm which extends below the lower surface of the cover when the cover is in the closed position, said cover mounting bracket being pivotally interconnected to said front pivot link at a third pivot, and further pivotally interconnected to said rear pivot link at a fourth pivot, said third pivot and said fourth pivot being positioned on said cover mounting bracket lower arm;

wherein said fourth pivot is positioned upwardly and rearwardly of said third pivot and upwardly and forwardly of said first and second pivots when the cover is in the closed position, and wherein said third pivot is positioned upwardly and forwardly of said fourth pivot and rearwardly and upwardly of said first and second pivots when the cover is in the open position.

* * * * *

UNITED STATES PATENT AND TRADEMARK OFFICE

CERTIFICATE OF CORRECTION

PATENT NO. : 5,466,041

DATED : November 14, 1995

INVENTOR(S) : Hoffman et al.

It is certified that error appears in the above-indentified patent and that said Letters Patent is hereby corrected as shown below:

Column 3, line 2, please start a new paragraph with the word "As".

Column 3, line 15, please start a new paragraph with the word "Referring".

Column 3, line 36, please start a new paragraph with the word "The".

Column 3, line 50, please start a new paragraph with the word "The".

Column 3, line 52, before "30a" please insert --30,--.

Column 4, line 34, "3" should be --31--.

Column 4, line 35, "3" should be --31--.

Column 5, line 26, before the word "and" please insert --16--.

Signed and Sealed this

Twentieth Day of May, 1997

*Attest:*

Bruce Lehman

BRUCE LEHMAN

*Attesting Officer*

*Commissioner of Patents and Trademarks*